United States Patent [19]

Asher

[11] 4,132,405

[45] Jan. 2, 1979

[54] BALANCED SWIVEL EXERCISING DEVICE

[76] Inventor: Nathan F. Asher, 1015 Sunset Blvd., Arcadia, Calif. 91006

[21] Appl. No.: 769,045

[22] Filed: Feb. 16, 1977

[51] Int. Cl.[2] ..... A63B 23/02

[52] U.S. Cl. ..... 272/146

[58] Field of Search ..... 272/146, 120, 126, 134, 272/137, 138, 136, 128, DIG. 5; D34/5 K; D24/42; 35/29 R; 128/25 B

[56] References Cited

U.S. PATENT DOCUMENTS

| | | | |
|---|---|---|---|
| 1,585,748 | 5/1926 | Wendelken | D34/5 K |
| 1,952,830 | 3/1934 | Wrobley | 272/126 |
| 2,906,532 | 9/1959 | Echols | 272/146 X |
| 3,100,639 | 8/1963 | Bonewitz | 272/146 |
| 3,593,994 | 7/1971 | Anbar | 272/146 |
| 3,784,193 | 1/1974 | Simjian | 272/DIG. 5 |
| 3,843,119 | 10/1974 | Davis | 272/126 |

FOREIGN PATENT DOCUMENTS

| | | | |
|---|---|---|---|
| 577226 | 5/1924 | France | 272/146 |
| 425573 | 5/1967 | Switzerland | 272/146 |

*Primary Examiner*—Richard J. Johnson

*Attorney, Agent, or Firm*—Poms, Smith, Lande, Glenny & Rose

[57] ABSTRACT

The present exercising device includes a swivel platform and hand-held control cords which may be operated through a pulley assembly. The swivel platform is made up of a large diameter circular platform rotatably mounted on an equal diameter circular base. The base is similar in shape to an oversized ping pong paddle with a circular head portion and an extending member corresponding to the handle of the paddle. The hand-held cords are connected either directly to the end of the extending member of the base or to pulleys secured to the extending member, to provide balance and coordinated rotation of the swivel platform. When pulleys are used, the two hand-held cords are each run through one of the two pulleys, and then connected to each side of the swivel platform. Each cord may be attached to one of two arms extending laterally from the swivel platform, or to the eyebolts connected to opposite sides of the platform. The cords can be adjusted to fit persons of all sizes.

10 Claims, 6 Drawing Figures

BALANCED SWIVEL EXERCISING DEVICE

BACKGROUND OF THE INVENTION

Up to the present, men and women have had a very difficult time finding a way to exercise many parts of their body in a limited period of time. Either they must spend hundreds of dollars per year to belong to a convenient gym or health spa, or they must buy several exercising devices, and use one for each part of their body that they wish to exercise and these devices are often heavy or bulky to transport, or even hazardous to the well-being of the exerciser and some of them may necessarily be inconveniently located because of the need for an outside fixture.

One known exercising device is a simple swivel platform. Used alone, one often has difficulty controlling the amount or direction of swivel, resulting in very little rhythm or exercise benefit. Using a device such as this where the spin might be uncontrolled, a person could easily become dizzy and be apt to fall. Normally, therefore, it is recommended that simple swivel platforms only be used near a supporting railing, to avoid accidents or the like.

Several exercising devices including apparatus shown in U.S. Pat. No. 1,240,191, U.S. Pat. No. 3,117,782, and U.S. Pat. No. 3,858,874 involve two cords and pulleys. Each cord is held in hand at one end, run through a pulley, and attached to some part of one's body at the other end. One of the patent devices can be used only to help the neck and spinal column, so it is not in the field of the invention. Two other such devices, which can only be used while lying down, both use pulleys and loops which are connected to the hands and feet. Accordingly these prior arrangements are also foreign to the concepts of the present invention.

SUMMARY OF THE INVENTION

The present invention contemplates a multipurpose exercising device which includes a base with a fixed extending member, a swivel platform mounted on the base, and a hand-held cord assembly. The hand-held cord assembly, which is coupled to the fixed extending member on the base, facilitates full exercise of the entire body under coordinated balanced conditions.

In accordance with one embodiment of the invention, pulleys may be mounted on the extending arm member, and cords may extend through these pulleys for connection to each side of the swivel platform. Laterally extending arms may be provided on each side of the swivel platform for connection to the ends of the hand-held cords, in order to increase arm and body movement.

In accordance with another aspect of the invention, the same increased motion may be obtained by including elasticity in the hand-held cords. For simplicity, the hand-held cords may merely be attached to the fixed base assembly, in accordance with another embodiment.

Other advantages, features and objects of the invention will become apparent from a consideration of the following detailed description and from the drawings.

BRIEF DESCRIPTION OF THE DRAWINGS

Referring in detail to the drawings, FIGS. 1 and 2 show an illustrative swivel exercising device in accordance with the invention, with major parts including a base 12, a bearing 14, a swivel platform 16, and hand-held cords 18 and 20. The base 12 includes a generally circular portion 22, and an extending arm 24. The bearing 14 is mounted on the generally circular portion 22 of the base 12 so that the swivel platform 16, which is mounted on bearing 14, may swivel. Two eyebolts, 26 and 28, are attached to the generally circular portion 22 of the base 12, on opposite sides of the base. Each of the hand-held cords, 18 and 20, are lines which can be made of one or a combination of many materials including elastic and nylon and they may be connected to one of the eyebolts, 26 and 28, which are secured to the base 12, with quick-fastening connectors, 30 and 32. As shown in FIG. 1, the connectors, 30 and 32, at the end of each hand-held cord, 18 and 20, can alternately be attached to diametrically opposed members, 34 and 36, which extend laterally from the swivel platform.

Figure 1:
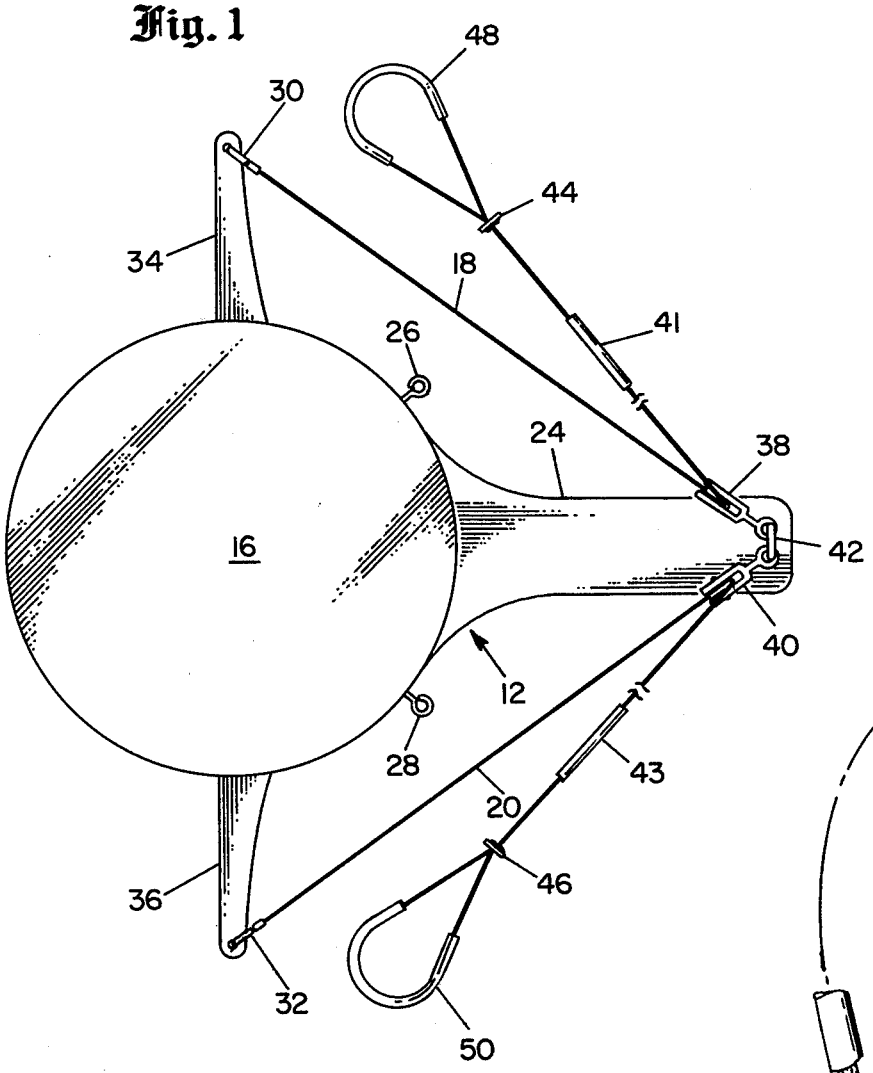
FIG. 1 is a plan view of the preferred embodiment of a swivel exercising device illustrating the principles of the invention.
Figure 3:
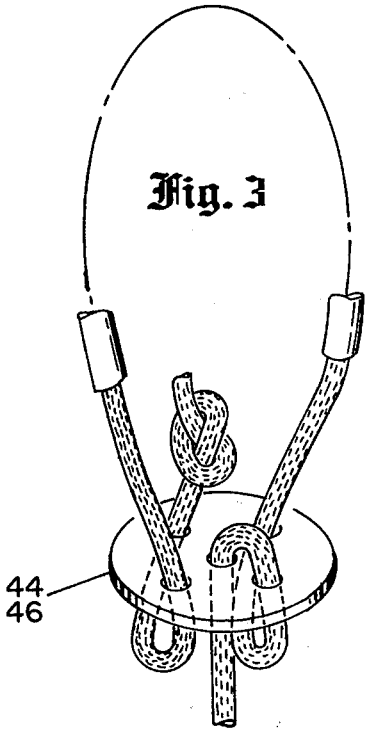
FIG. 3 shows a disc with five holes which may be used for adjusting the length of the hand-held cords.

Each of the hand-held cords, 18 and 20, is run through one of two pulleys, 38 and 40, before being connected to either the extending members, 34 and 36, or the eyebolts, 26 and 28. The pulleys, 38 and 40, are connected to an eyebolt 42 which is attached to the extending arm 24 of the base 12. The ends of the hand-held cords, 18 and 20, which are to be held are formed into loops using five holed discs 44 and 46. As well as forming each of the hand-held cords, 18 and 20, into easy-to-hold loops, the five holed discs, 44 and 46, serve as an easy method of adjusting the length of each of the hand-held cords, 18 and 20. To make it even easier to hold the loops, small pieces of plastic tubing, 48 and 50, may be slipped over each of cords 18 and 20.

Additionally, on each of the hand-held cords 18 and 20 between the five holed disc, 44 or 46, and the pulley, 38 and 40, resilient or elastic members 41 and 43 are provided to permit increased and smoother movement of the arms and body in actuating the cords 18 and 20.

Figure 4:
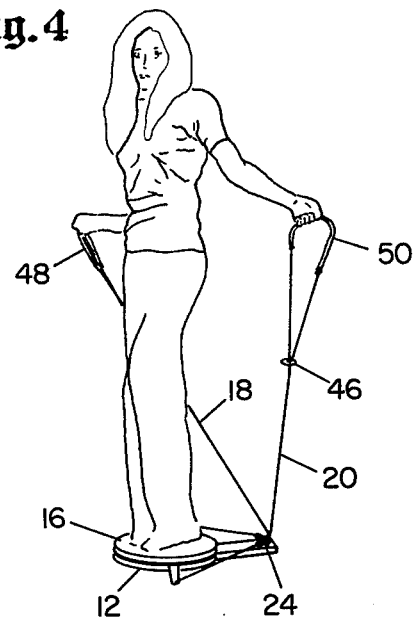
FIG. 4 shows a demonstration of one method of using the preferred embodiment of the swivel exercising device.

FIG. 4 shows a woman demonstrating the versatility of one embodiment of the invention. By holding on to the plastic handles, 48 and 50, of the hand-held cords, 18 and 20, while facing in a direction opposite that of the extending arm 24 of the base 12, she is demonstrating one of the many exercise modes possible with the present versatile apparatus. Skiing exercises may also be accomplished with the device with the user facing the other direction; and ankle and leg strengthening for skiing is an important variant of the exercise routine.

Figure 2:
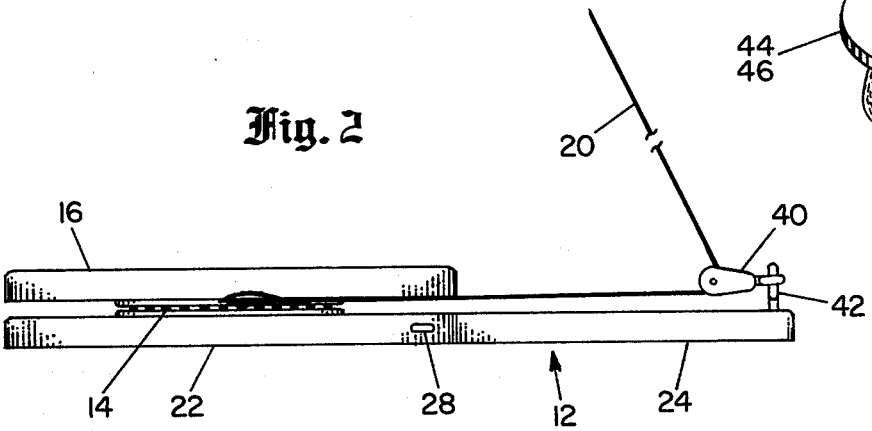
FIG. 2 is a side view of the swivel exercise device of FIG. 1.
Figure 5:
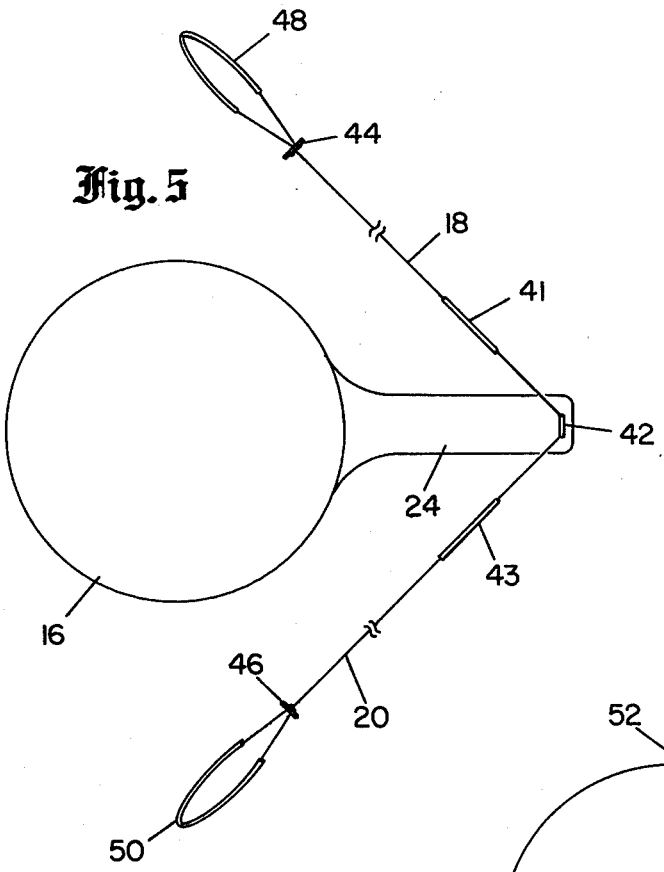
FIG. 5 is a plan view of an alternative embodiment of the swivel exercising device which uses no pulleys.
Figure 6:
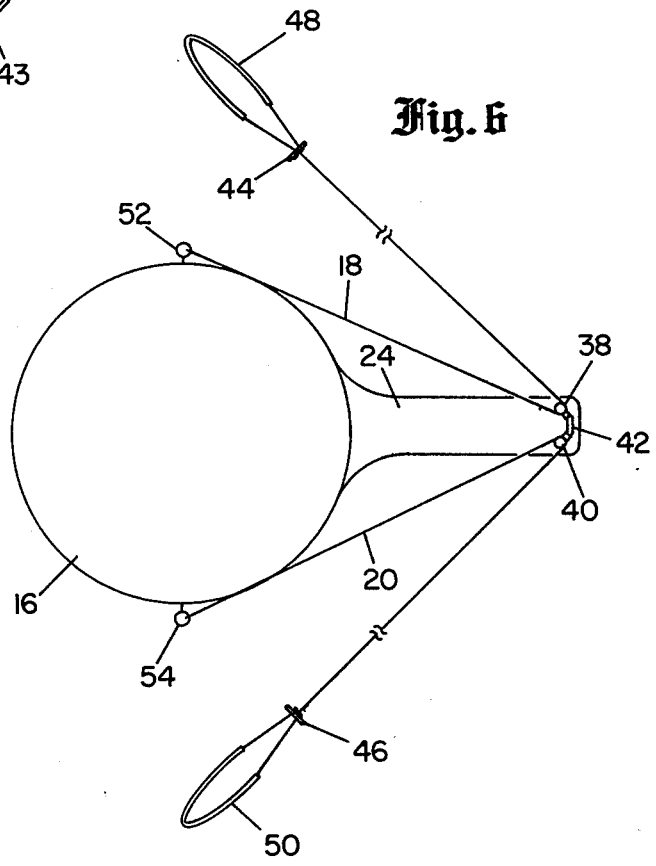
FIG. 6 is a plan view of an embodiment of the swivel exercising device which uses eyebolts instead of arms attached to the swivel platform.

FIGS. 5 and 6 are both embodiments of swivel exercisers similar to the preferred embodiment shown in FIGS. 1 and 2. FIG. 5 has a very different hand-held cord assembly. The eyebolts, 26 and 28, the quick-fastening connectors, 30 and 32, the diametrically opposed members, 34 and 36, and the pulleys, 38 and 40, have all been deleted. Instead, the hand-held cords, 18 and 20, are permanently attached to an eyebolt 42, which is attached to the fixed extending arm 24 or the base 12.

FIG. 6 is similar in all respects to FIG. 1, except that the diametrically opposed members, 34 and 36, are replaced by diametrically opposed eyebolts, 52 and 54, on the swivel platform 16.

One factor which may be noted in connection with FIGS. 1, 2 and 6, is the difference in swivel movement for a given amount of arm movement in the two different embodiments. In FIG. 1, of course the swivelling is somewhat less for a given amount of arm and cord movement, than in FIG. 6, because of the longer radius point relative to the swivel platform to which the lines are attached.

In the foregoing detailed description the invention has been described in connection with certain specific embodiments shown in the drawing. The present invention is, however, not limited to these specific embodiments. For example, a large diameter smooth metal ring or two of them could be substituted for the pulleys employed in FIGS. 1, 2 and 6, with a nylon line being employed to reduce friction. Also, to change the ratio of arm movement to the extent of platform rotation, additional pulleys could be used, with such a pair of additional pulleys being attached to the eyebolts 52 and 54, respectively, in FIG. 6. The lines would then be threaded through these additional pulleys, as well as the first pair, and then secured back to the fixed extending member 24. Accordingly, it is understood that the present invention is only limited by the appended claims.

What is claimed is:

1. A dynamic exercising apparatus for the entire body comprising:

a base;

a fixed extending member secured to said base;

a swivel platform rotatably mounted on said base for rotation about a substantially vertical axis;

means including first and second lines slidably coupled to said extending member for balancing and controlling coordinated swivelling of said platform and movement of the arms and body;

first and second handle means connected respectively to said first and second lines but otherwise separate from one another; and means for attaching said lines from said fixed extending member to opposite sides of said swivel platform to rotate said platform and the lower portion of the user's body in one direction when one of said lines is pulled and in the other direction when the other of said lines is pulled.

2. A dynamic exercising apparatus as defined in claim 1 wherein said balancing and controlling means includes resilient linking means for smoothly stopping or reversing the direction of motion of said swivel platform.

3. A dynamic exercising device as defined in claim 2, wherein means are provided for adjusting the lengths of the cords.

4. A dynamic exercising apparatus as defined in claim 1 wherein pulleys are secured to said fixed extending member of the base.

5. A dynamic exercising device as defined in claim 1 wherein said swivel platform is provided with arms extending laterally from opposite sides, and wherein said lines are attached to said arms.

6. A dynamic exercising apparatus as defined in claim 1 further including means for decreasing the amount of swivel movement for a given amount of cord movement as compared with direct securing of the cords at the edges of the swivel platform.

7. An exercising apparatus as defined in claim 6 wherein said swivel decreasing means includes laterally extending arms secured to said swivel platform to which said lines are attached.

8. An exercising apparatus as defined in claim 1 wherein said attaching means includes eyebolts secured to opposite sides of said swivel platform.

9. A dynamic exercising apparatus for the entire body comprising:

a base;

a fixed extending member secured to said base;

a swivel platform rotatably mounted on said base;

said swivel platform and the main portion of said base both being substantially circular and concentrically mounted with respect to one another; and means including a pair of lines slidably coupled to said extending member for balancing and controlling coordinated swivelling of said platform and movement of the arms and body; and means for attaching said lines from said fixed extending member to opposite sides of said swivel platform to rotate said platform and the lower portion of the user's body in one direction when one of said lines is pulled and in the other direction when the other of said lines is pulled.

10. A dynamic exercising apparatus for the entire body comprising:

a base;

swivel platform means for accommodating the feet of the user of the exercising apparatus;

means for mounting said swivel platform for rotatable movement about a substantially vertical axis;

pulley means fixedly secured in position with respect to said base;

means including first and second lines extending through said pulley means for balancing and controlling coordinated swivelling of said platform and movement of the arms and body;

first and second handle means connected respectively to said first and second lines but otherwise mechanically independent of one another; and means for securing each of said lines to opposite sides of said swivel platform, whereby the user may actuate said lines by applying force to said handle means to swivel said platform first in one direction and then in the other direction in a smooth balanced, controlled manner which exercises the entire body.

* * * * *